US006071217A

United States Patent [19]

Barnett

[11] Patent Number: 6,071,217

[45] Date of Patent: Jun. 6, 2000

[54] PRONE TORSO EXERCISER

[76] Inventor: Larry W. Barnett, 12 Nimrod Farm Rd., Weston, Conn. 06883

[21] Appl. No.: 08/957,962

[22] Filed: Oct. 21, 1997

Related U.S. Application Data

[60] Provisional application No. 60/029,016, Oct. 24, 1996.

[51] Int. Cl.[7] ..... A63B 21/02

[52] U.S. Cl. ..... 482/121; 482/122; 482/95; 482/96; 482/126

[58] Field of Search ..... 482/95, 96, 114, 482/116, 121, 122, 123, 126, 130, 131, 132

[56] References Cited

U.S. PATENT DOCUMENTS

| | | | |
|---|---|---|---|
| 1,824,920 | 9/1931 | Novak . | |
| 1,984,165 | 12/1934 | Tolchin | 482/95 |
| 2,129,262 | 9/1938 | Cole . | |
| 3,101,944 | 8/1963 | Cencig . | |
| 3,572,701 | 3/1971 | Agamian . | |
| 3,582,069 | 6/1971 | Flick et al. . | |
| 3,589,720 | 6/1971 | Agamian . | |
| 3,620,530 | 11/1971 | Cosby | 272/82 |
| 3,752,475 | 8/1973 | Ott . | |
| 3,797,824 | 3/1974 | Osbourne . | |
| 4,136,867 | 1/1979 | Wilkin . | |
| 4,324,399 | 4/1982 | Rickey . | |
| 4,506,884 | 3/1985 | Hankin . | |
| 4,653,749 | 3/1987 | Rorabaugh . | |
| 4,930,769 | 6/1990 | Nenoff . | |
| 4,989,860 | 2/1991 | Iams et al. . | |
| 5,110,122 | 5/1992 | Moore et al. . | |
| 5,205,804 | 4/1993 | Hall . | |
| 5,224,909 | 7/1993 | Hamilton . | |
| 5,261,866 | 11/1993 | Mattox . | |
| 5,279,530 | 1/1994 | Hess | 482/70 |
| 5,295,935 | 3/1994 | Wang . | |
| 5,316,535 | 5/1994 | Bradbury | 482/135 |
| 5,328,427 | 7/1994 | Sleamaker . | |
| 5,498,223 | 3/1996 | Iams et al. . | |
| 5,499,955 | 3/1996 | Becker et al. . | |
| 5,499,958 | 3/1996 | Hess | 482/79 |
| 5,499,961 | 3/1996 | Mattox . | |
| 5,518,483 | 5/1996 | Oswald . | |
| 5,643,162 | 7/1997 | Landers et al. . | |
| 5,921,901 | 7/1999 | Palacios . | |

FOREIGN PATENT DOCUMENTS

| | | |
|---|---|---|
| 436 269 | 10/1935 | United Kingdom . |
| 2 133 706 | 8/1984 | United Kingdom . |
| 2 160 433 | 12/1985 | United Kingdom . |

*Primary Examiner*—Richard J. Apley
*Assistant Examiner*—Tam Nguyen
*Attorney, Agent, or Firm*—Finnegan, Henderson, Farabow, Garrett & Dunner, L.L.P.

[57] ABSTRACT

An exercise apparatus which comprises a track, a track carriage slidably disposed on the track, and a resistance system for providing unidirectional, selectively variable resistance to the track carriage. The track carriage is capable of sliding along the track in a first direction when a force is applied to the track carriage sufficient to overcome the resistance force of the resistance system, and whereby the track carriage is capable of sliding along the track in a direction opposite to the first direction when the applied force is diminished.

13 Claims, 8 Drawing Sheets

PRONE TORSO EXERCISER

This application claims a right of priority to U.S. provisional application No. 60/029,016, filed Oct. 24, 1996 and entitled Prone Torso Exerciser.

BACKGROUND OF THE INVENTION

This invention relates to an exercise device and, more particularly, to an exercise device utilizing resistance and gravity to work the muscles of the user, particularly those of the upper and lower body.

Generally, exercise devices are known in the art that provide a framework for individuals to extend their upper torsos from a kneeling position to a prone position in order to strengthen and stretch various muscle groups of the upper torso. Indeed, as disclosed in the Cencig U.S. Pat. No. 3,101,944, issued Aug. 27, 1963, a typical apparatus would include a bimanual sliding member that could be propelled along a sliding surface by the user stretching the user's body from a kneeling to a prone position, and vice-versa.

However, known exercise devices are limited in several respects. For example, to the extent that such a device would employ resistant forces to inhibit the movement of a bimanual sliding member, that resistance could not be readily varied to adapt to the strength of the user. Further still, prior art devices did not provide adjustable resistance by elevating a track on which the bimanual sliding member maneuvered. Additionally, such prior devices were not adaptable to provide an exercise regime particularly and individually directed to the muscles groups of the arms, chest, or legs. Finally, such prior art devices were relatively bulky, heavy and difficult to store in small storage areas.

Accordingly, there developed a need for a low-cost, portable exercise device that provides a progressive resistance exercise regimen that not only allows for the concentric and eccentric contraction of the abdominal muscles, but also of the shoulder, arm, chest, back, leg and buttock muscle groups for a user of largely any physical condition.

SUMMARY OF THE INVENTION

In view of the foregoing considerations and problems known in the art, the exercise apparatus in accordance with the present invention comprises a track, a track carriage slidably disposed on the track, and a resistance system for providing a unidirectional, selectively variable resistance to the track carriage. The track carriage is capable of sliding along the track in a first direction when a force is applied to the track carriage sufficient to overcome the resistance force of the resistance system, and whereby the track carriage is capable of sliding along the track in a direction opposite to the first direction when the applied force is diminished.

In a further aspect of the invention, the track includes an elongated track member, a vertical support, and a strut. The track member is pivotally connected at a first end to the strut, and the opposite end is adjustably affixed to the vertical support. Moreover, the track member provides a surface for slidably carrying the track carriage, and may be adjustably elevated at one end from a generally horizontal position to an inclined slope position.

Preferably, the resistance system includes at least one elongated elastic member that is releasably attached to the track carriage, where one end of which is releasably attached to the track carriage to vary the resistance of the resistance system. Further, the elastic member is directed toward the track carriage by a pulley that is located near the pivot connection between the strut and track member.

Further still in accordance with the present invention, the exercise apparatus includes user engagement members, such as handles or a detachable platform for maneuvering the track carriage, in addition to pads for cushioning the knees or the chest of the user during the performance of an exercise.

Other aspects and advantages of the invention will be set forth in part in the description which follows, and in part will be apparent from the description, or may be learned by practice of the invention.

BRIEF DESCRIPTION OF THE DRAWINGS

The accompanying drawings, which are incorporated in and constitute part of the specification, illustrate preferred embodiments of the invention and, together with a description,, serve to explain the principles of the invention.

In the drawings.

DETAILED DESCRIPTION OF THE PREFERRED EMBODIMENT

Reference will now be made to the present preferred embodiment of the invention, which is illustrated in the accompanying drawings.

Figure 1:
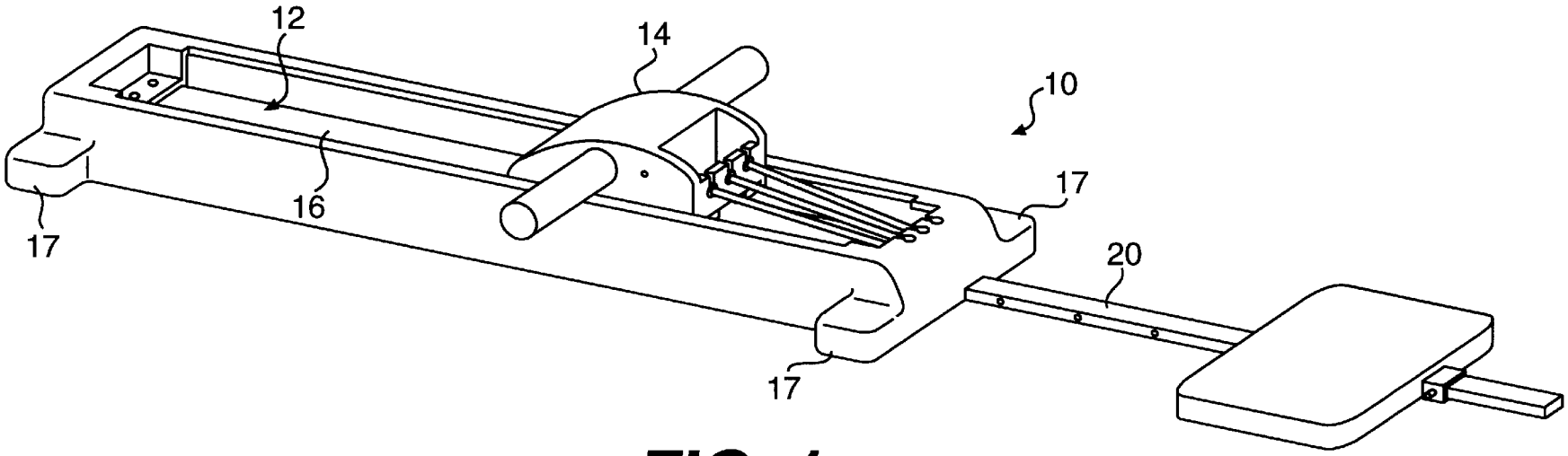
FIG. 1 is a perspective view of an exercise apparatus according to the present invention.

Generally, in accordance with the present invention, the preferred exercise apparatus includes a track and a track carriage slidably disposed on the track. The track includes an elongated track member, a strut, and stabilizing supports. As embodied herein and with reference to FIGS. 1 and 2, an exercise apparatus is designated generally by the numeral 10. The exercise apparatus 10 includes a track 12 and a track carriage 14. The track 12 includes an elongated track member 16 that is connected at its end to a strut 20. Preferably, stabilizing supports 17 are mounted to the track 12 in order to restrict the lateral movement of the exercise apparatus 10.

In further accordance with the present invention, a resistance system is connected to the track and track carriage, and provides unidirectional, selectively variable resistance to the track carriage, whereby the track carriage is capable of sliding along the track in a first direction when a force is applied to the track carriage sufficient to overcome the resistance force of the resistance system, and whereby the track carriage is capable of sliding along the track in a direction opposite the first direction when the applied force is diminished. Preferably, the resistance system includes at least one elongated elastic member, one end of which is releasably attached to the track carriage to vary the resistance force of the resistance system. Further, at least one pulley near the pivot connection of the strut and track member is provided for directing the elongated elastic members toward the track carriage.

Figure 2:
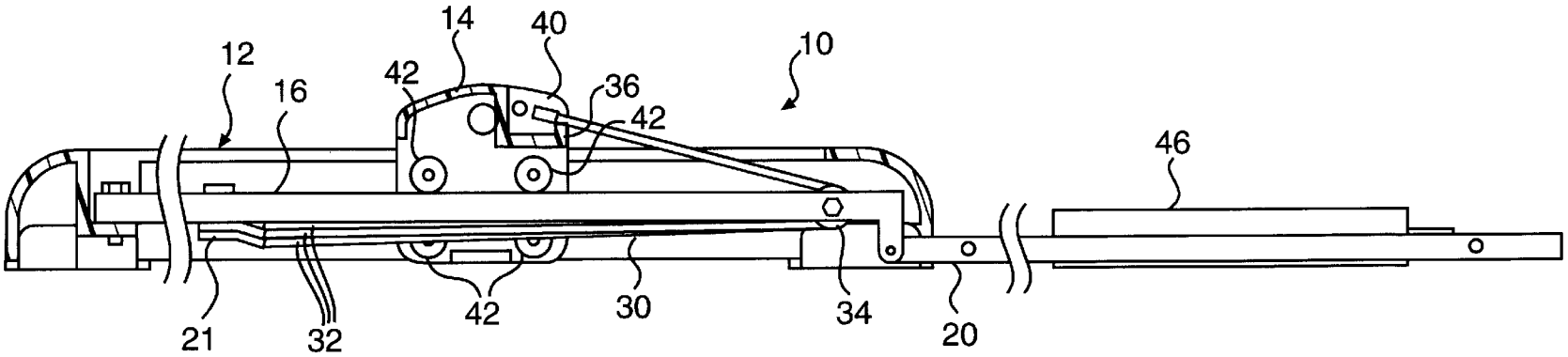
FIG. 2 is a cross-sectional side view of an exercise apparatus according to the present invention.
Figure 3:
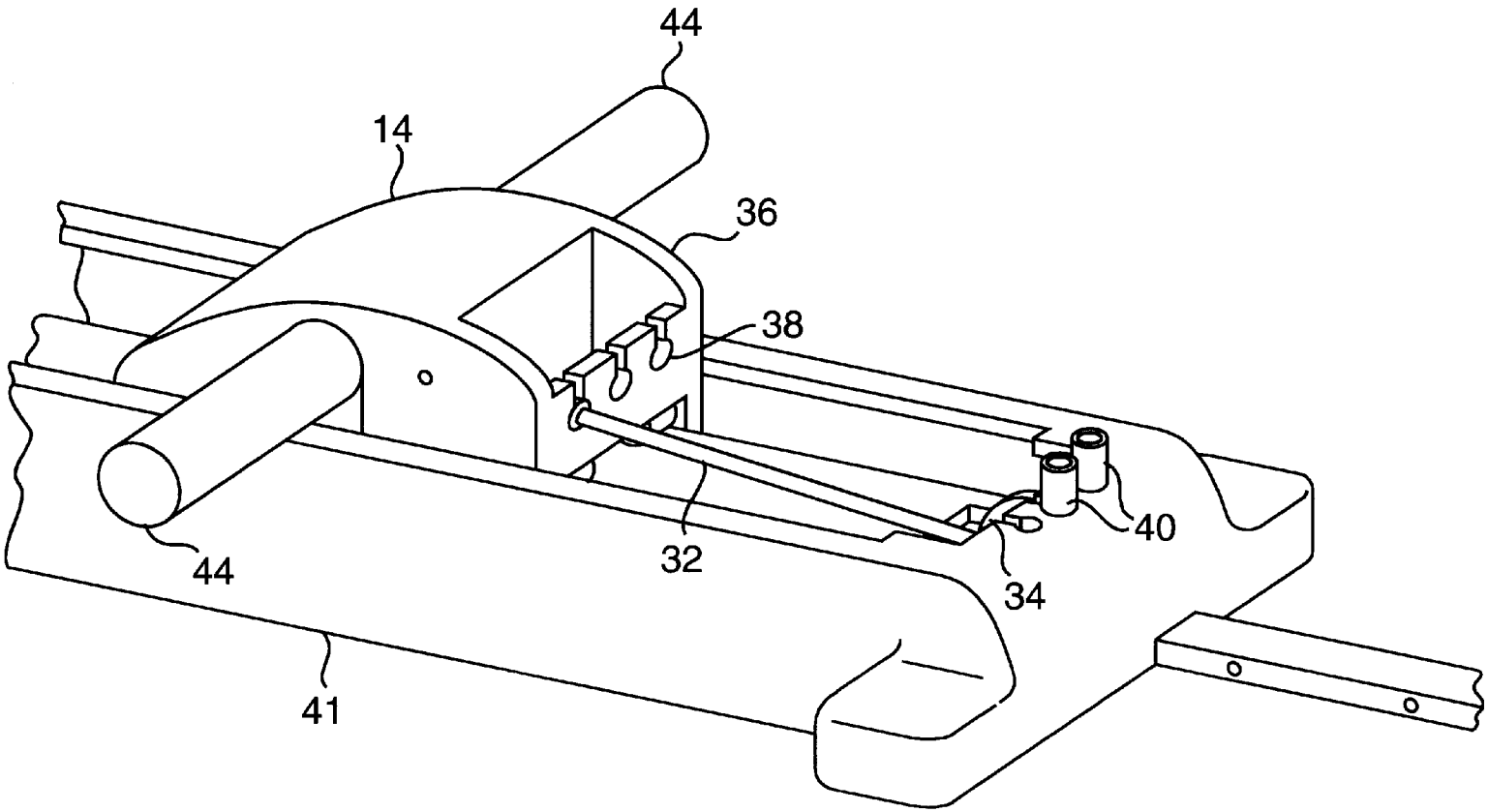
FIG. 3 is a partial perspective view of an exercise apparatus according to the present invention.
Figure 4:
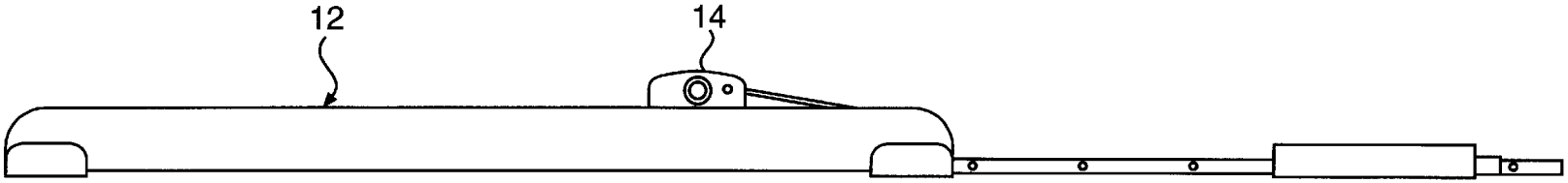
FIG. 4 is a side view of an exercise apparatus according to the present invention.
Figure 5:
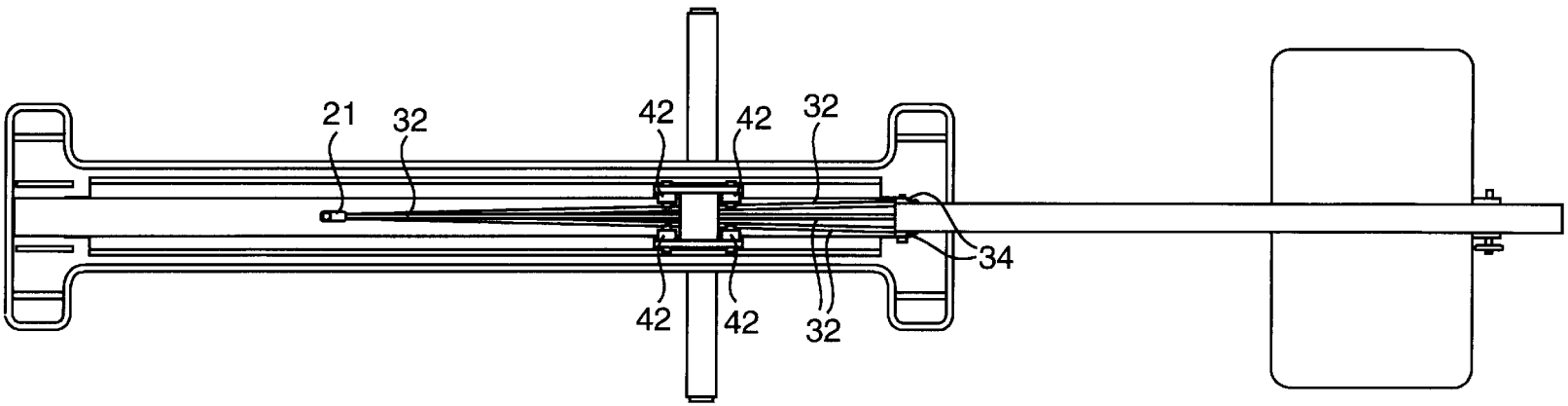
FIG. 5 is a bottom view of an exercise apparatus according to the present invention.

As embodied herein and with initial reference to FIG. 2, a resistance system 30 includes elastic members 32 of a material that resist tensile loading (preferably of a bungi cord-like material), and are individually carried by pulleys 34, which are mounted to the track member 16. Each elastic member 32 is bolted to the track member 16 by attachment 21, threaded through one of the pulleys 34, and is attached to a support plate 36 of the track carriage 14. As can be seen in FIG. 3, the support plate 36 has slots 38 for the receiving of elastic members 32. Further still, a stop 40 is placed upon each elastic member 32 to secure the elastic member when it is placed within a respective slot 38, or to alternatively prevent the elastic member from passing through the pulley once a elastic member is released from a slot.

FIG. 2 illustrates that there are three elastic members 32. Preferably, the elastic members 32 are of varying strength and may be selectively attached to the support plate 36 by the user to increase the amount of force needed to move the track carriage 14 in a direction away from the pulleys 34. Because the elastic members 32 are elastic, a user may stretch the elastic member either to place or remove the elastic member from one of the slots 38. Further, the number of elastic members may be increased, or replaced with members of greater or lesser resistance depending on the user's election. Also, FIG. 3 shows that track 12 includes a protective housing 41 placed about the elastic members to shield the elastic members from damage, or injury to the user should the elastic members break or become dislodged during operation.

It should be appreciated that the resistance system for the exercise apparatus may include other forms that provide unidirectional, selectively variable resistance. For example, in lieu of elastic members, rather, friction rollers, hydraulic devices, compression springs, etc. may be employed to provide resistance against the movement of the track carriage in one direction and facilitate a return movement of the track carriage in the other direction. Such other devices should allow the user to regulate the amount of resistance applied to the track carriage.

In further accordance with the present invention, the track carriage includes at least one bearing engaging the track member. As embodied herein and with continued reference to FIG. 2, the bearing members 42 are bolted to the track carriage 14 and slidably engage the track member 16. As shown, eight bearing members 42 are positioned to roll against (both above and below) the track member 16, and provide a smooth sliding motion to the track carriage 14. The bearing members 42 are preferably made of nylon, or of a similarly durable material having a low coefficient of friction.

Still in further accordance with the present invention, the exercise apparatus includes user engagement members, such as a handle or a detachable platform for maneuvering the track carriage, as well as pads for cushioning the knees or chest of the user. As embodied herein and with reference to FIGS. 2 and 3, handles 44 are mounted on either side of the track carriage 14 and provide a surface for the user to engage and maneuver the track carriage. Further shown in FIG. 2 is pad 46, which provides a surface to support the user's knees and is suitably mounted to the strut 20, and may be adjusted along the strut depending on the user's preference.

Figure 6:
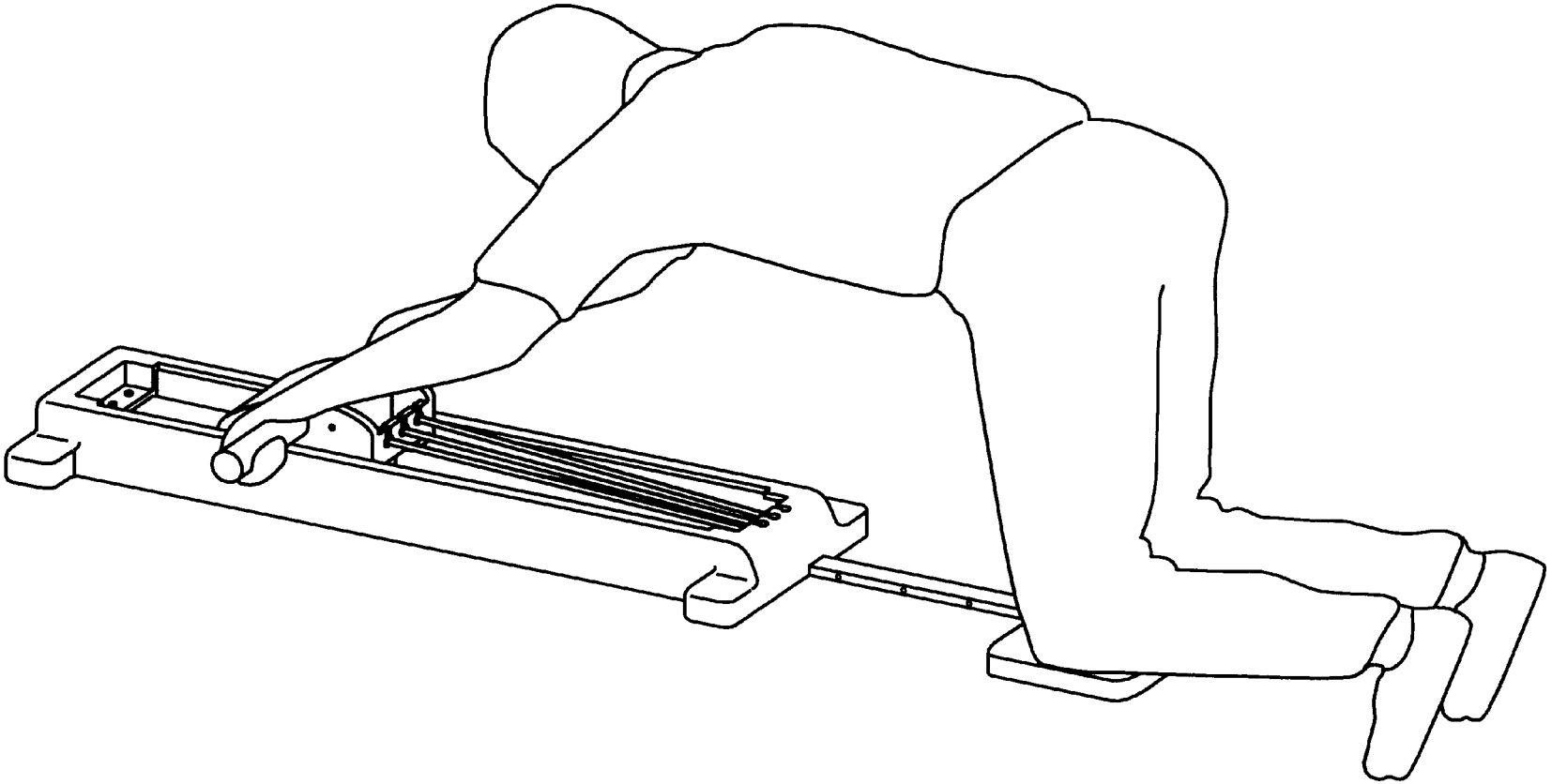
FIG. 6 is a perspective view of an user operating an exercise apparatus according to the present invention.

As described, the exercise apparatus of the present invention exercises the abdominal muscle group, while also exercising other upper body muscles groups such as the shoulders, chest, arms, and back. In operation as shown in FIG. 6, the exercise apparatus is utilized by placing the user's knees on the pad, grasping the handles of the track carriage, and then extending the user's upper body while holding onto the handles of the track carriage. As the user extends forwardly, the track carriage moves toward the opposite end of the track member, encountering increasing resistance from the resistance system. The contraction of the muscles activates the muscle fibers, and the further the user stretches the more fibers that are activated, thereby leading to a more vigorous workout. Thus, for example, as the user's abdominal muscles are stretched and contracted in a controlled motion when the user extends forward, those muscles both contract and lengthen, resulting in a negative contraction. Once the user has reached a desired extension along the track member, he returns to the starting position with the aid of the resistance system, which pulls the track carriage back to its original position. The return motion requires the contraction and shortening of the abdominal, as well as the lower back muscles, resulting in a positive contraction. By the repetition of moving back and forth from the kneeling-prone position, the user receives a vigorous, upper body workout.

Of further importance is that the resistance system provides variable tension to allow users of differing strength capabilities to use the exercise apparatus. For example, the resistance system compensates for users having weak abdominal muscle groups by exerting a force opposite to the direction of the forward movement of the track carriage. The intensity of the exercise can be varied by changing the resistance of the resistance system. Preferably, greater resistance decreases the difficulty of the exercise.

Although the resistance system facilitates the exercise of the abdominal muscles as the user extends his body along the track member, as well as other upper body muscle groups, user may perform alternative exercises by using the track carriage and resistance system in a different fashion. Alternatively, the user may exercise his gluteus and hamstrings by placing his foot on the foot platform and extending his leg along the track member.

Figure 7:
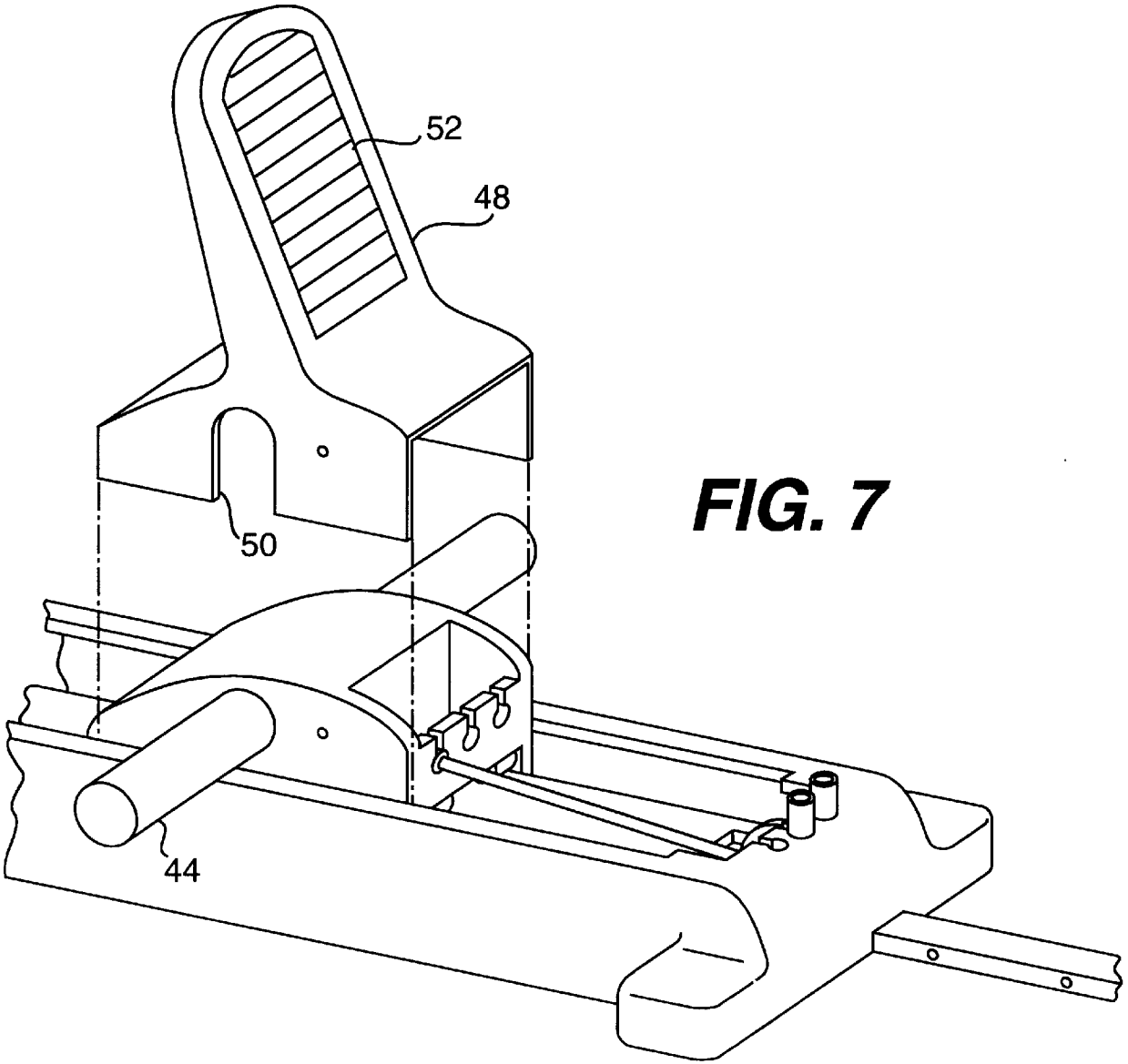
FIG. 7 is a partial perspective view of an exercise apparatus according to the present invention.
Figure 8:
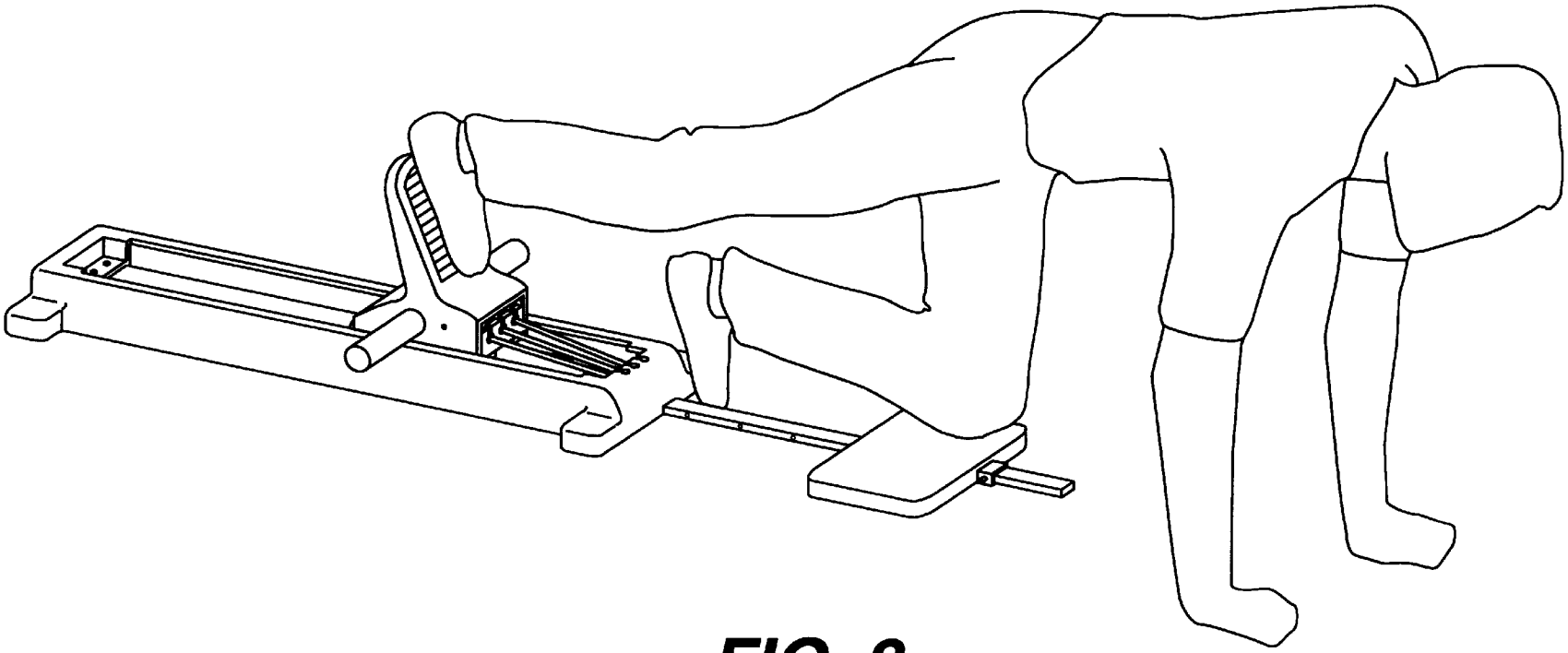
FIG. 8 is a perspective view of an user operating an exercise apparatus according to the present invention.

In further accordance with the present invention, a detachable platform may be affixed to the track carriage in order to allow a user to exercise his leg muscles. As embodied herein and with reference to FIG. 7, platform 48 is designed to fit onto the track carriage 14 and has two slots 50 that engage the handles 44. Platform 48 has a foot pad 52 for engaging the foot of the user when performing leg extensions with the foot platform 48 (known in the art as "donkey kicks"), as illustrated by FIG. 8.

Still in further accordance with the present invention, the track includes an elongated track member, a vertical support, and a strut, where the first end of the track member is pivotally connected to the strut and the opposite end of the track member is adjustably affixed to the vertical support. Further, the lower end of the vertical support is pivotally connected to one end of the strut.

Figure 9:
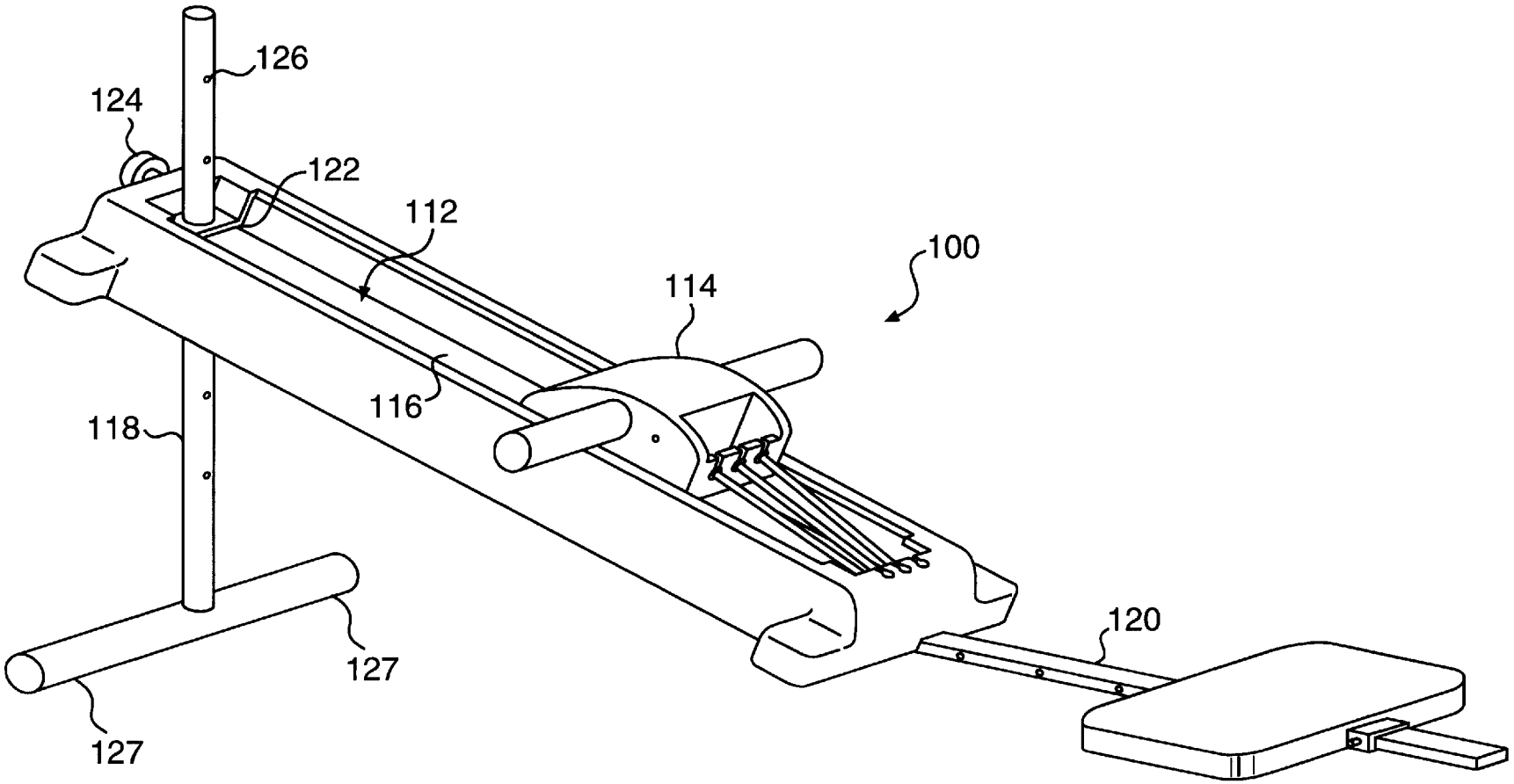
FIG. 9 is a perspective view of an exercise apparatus according to the present invention.

As embodied herein and with reference to FIG. 9, an exercise apparatus is designated generally by the numeral 100. The exercise apparatus 100 includes a track 112 and a track carriage 114. The track 112 includes an elongated track member 116 that is pivotally connected at one end to a strut 120. Track member 116 is pivotally connected at its other end to a sleeve 122 that is adjustably carried by a vertical support 118. As can be appreciated, the sleeve 122 can be maneuvered along the vertical support 118 and fixed into a pre-selected location through the use of a lock pin 124. Preferably, stabilizing supports 127 are mounted to the vertical support 118 in order to restrict the lateral movement of the exercise apparatus 10. The pivotal connections (126) allow for the track member 116 to elevate from a generally horizontal position to a substantially vertical one relative to the user. By elevating the track member, the user can alleviate the amount of exertion required to perform the prone exercise described above. Additionally, by elevating the track member, the user may exercise different muscles groups.

It will be apparent to those skilled in the art that modifications and variations can be made in the above-described embodiments of the present invention without departing from the scope or spirit of the invention. Thus, it is intended that the present invention cover such modifications and variations provided they come within the scope of the appended claims and their equivalents.

What is claimed is:

1. An exercise apparatus comprising:

a track including an elongated track member having first and second ends substantially opposite to one another;

a track carriage slidably disposed on the track; a resistance system for providing unidirectional, selectively variable resistance to the track carriage;

a strut connected to the first end of the track member, the strut extending in a direction substantially parallel to the track member; and a pad on the strut, the pad being adjustable along the strut to facilitate use of the exercise apparatus by different sized users;

whereby the track carriage is capable of sliding along the track in a first direction when a force is applied to the track carriage sufficient to overcome the resistance force of the resistance system, and whereby the track carriage is capable of sliding along the track in a second direction opposite to the first direction when the applied force is diminished.

2. The exercise apparatus of claim 1, wherein the resistance system includes at least one elongated elastic member, one end of which is releasably attached to the track carriage to vary the resistance force of the resistance system.

3. The exercise apparatus of claim 2, wherein said apparatus includes a plurality of elongated elastic members, each being releasably attached to the track carriage.

4. The exercise apparatus of claim 1, further comprising a vertical support member for changing the position of the track from a generally horizontal position to an inclined slope position.

5. The exercise apparatus of claim 4, wherein the vertical support member is adjustably connected to the second end of the track member.

6. The exercise apparatus of claim 3, wherein the resistance system includes at least one pulley near the connection of the strut and the first end of the track member, the pulley directing the elongated elastic members toward the track carriage.

7. The exercise apparatus of claim 1, wherein the track carriage includes at least one bearing engaging the track member.

8. The exercise apparatus of claim 1, further comprising at least one user engagement member for allowing a user to engage the apparatus.

9. The exercise apparatus of claim 8, wherein the at least one user engagement member includes at least one handle connected to the track carriage.

10. The exercise apparatus of claim 8, wherein the at least one user engagement member includes a detachable platform on the track carriage.

11. The exercise apparatus of claim 1, wherein a housing is provided to substantially encase the resistance system.

12. The exercise apparatus of claim 1, wherein the strut is pivotally connected to the first end of the track member.

13. The exercise apparatus of claim 12, wherein the pivotal connection allows the strut to pivot in at least a vertical direction.

* * * * *